United States Patent [19]

Raman

[11] 4,192,389

[45] Mar. 11, 1980

[54] SINGLE IMPACT RIVET GUN

[75] Inventor: Rune E. B. Raman, Bellevue, Wash.

[73] Assignee: Boeing Commercial Airplane Company, Seattle, Wash.

[21] Appl. No.: 930,456

[22] Filed: Aug. 2, 1978

[51] Int. Cl.[2] ..... B23Q 5/00; E21C 5/00

[52] U.S. Cl. ..... 173/15; 173/121; 173/134; 91/417 R

[58] Field of Search ..... 173/1, 15, 121, 134; 91/5, 417 R, 417 A; 227/130; 92/30 B, 34

[56] References Cited

U.S. PATENT DOCUMENTS

| | | | |
|---|---|---|---|
| 2,303,666 | 12/1942 | Souter | 91/5 |
| 2,960,067 | 11/1960 | Osbourne | 91/417 A |
| 3,255,674 | 6/1966 | Nelson et al. | 91/417 R X |
| 3,288,339 | 11/1966 | Bade | 227/130 |
| 3,711,008 | 1/1973 | Clifford et al. | 227/130 X |
| 4,039,034 | 8/1977 | Wagner | 173/15 X |

FOREIGN PATENT DOCUMENTS

| | | | |
|---|---|---|---|
| 996071 | 8/1951 | France | 173/134 |
| 56060 | 12/1952 | France | 173/134 |

*Primary Examiner*—Lawrence J. Staab

*Attorney, Agent, or Firm*—Morris A. Case; Bernard A. Donahue

[57] ABSTRACT

A single impact rivet gun has a piston freely movable within a cylinder that is surrounded by an air accumulator. A valve to control flow of the air from the accumulator to the inside of the cylinder is located at one end of the cylinder and the valve has an opening leading from outside the gun to the inside of the cylinder. The gun includes means for introducing a vacuum at the opening to pull the piston to a starting position.

8 Claims, 5 Drawing Figures

SINGLE IMPACT RIVET GUN

BACKGROUND OF THE INVENTION

Rivet setting guns are used extensively in industry. It used to be that most of these guns used multiple impact to set the rivet, but more and more these guns are of a single impact type as it is faster and less noisy. These single impact guns use a built in accumulator to obtain the volume of air required for a single impact, and they require considerable valving of one type or another to control the flow of air from the accumulator and to return the piston ram to a starting position.

In U.S. Pat. No. 2,303,666 to Souter, a stream of compressed air is used to drive a piston ram to the starting position and start an accumulator control valve to move to an open position; while linkage from the moving valve opens up the working end of the gun to atmosphere; then compressed air from within the valve starts the ram on the drive stroke.

In U.S. Pat. No. 2,960,067 to Osborne, a piston ram moves inside a cylinder and also along an axially located tube. Compressed air from within the tube drives the ram back to the starting position.

In U.S. Pat. No. 4,039,034 to Wagner, air build up in an accumulator initiates pressure through a metering valve into the back side of a piston ram that is acting as a valve between a cylinder and the accumulator, and the pressure forces the piston ram forward to then be driven by air from the accumulator.

SUMMARY OF THE INVENTION

A single impact rivet gun has a piston to be energized by compressed air from an accumulator in the gun to slideably move within a cylinder to strike an anvil for setting a rivet. The gun has openings at the working or anvil end of the cylinder that are continuously communicating from inside the cylinder to atmosphere and has an opening at the opposite end to which means is applied to pull the piston to starting position.

It is an object of this invention to provide a single impact rivet gun having means for pulling an anvil impacting piston to a starting position.

It is another object of this invention to provide a single impact rivet gun with an interlock to prevent premature firing of the gun.

It is an object of this invention to provide a single impact gun with simplified control valving.

DETAILED DESCRIPTION

Figure 5:
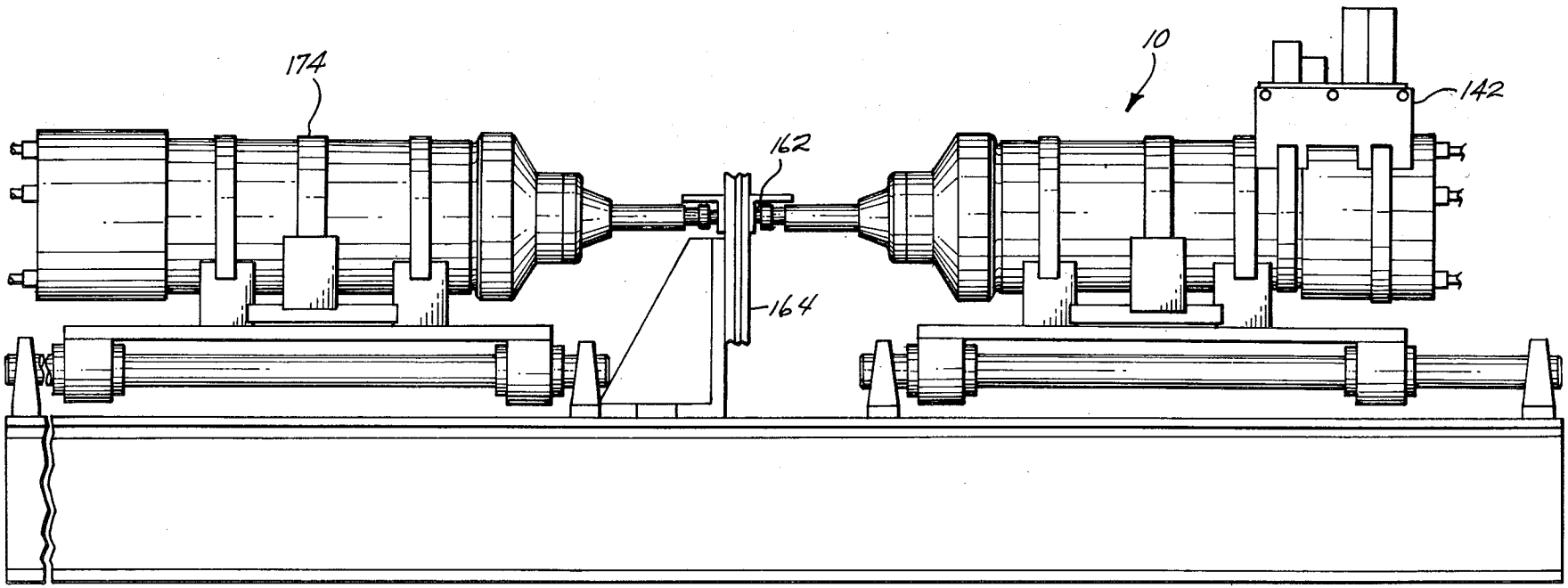
FIG. 5 shows a side elevational view of the rivet gun of this invention paired up with a bucking cylinder for automatic riveting operations.

A single impact rivet gun 10 made up of a housing 12 with barrel 14, an end cap 16 located at the working end of the gun, and a retaining ring 18 and an end cap 20 located at the non-working or control end of the gun. The barrel is threaded at 22 for joining to the working end cap and at 24 for joining to the retaining ring and has O-rings 26 and 28 for effecting an air tight seal between those parts. The end cap at the control end is joined to the retaining ring with a series of bolts not shown that extend through the end cap and thread into the retaining ring. A cylinder 30 is located inside the housing to provide the support for a piston or ram 32 that is freely movable within the cylinder. The cylinder is held in spaced relationship with regard to the barrel with a pair of spacers each of which consists of a pair of concentric rings joined together at several places around the periphery to keep the rings in concentric relationship with respect to each other. The first spacer 34 is located at the working end of the cylinder. The second spacer 36 located at the opposite end of the cylinder also serves to lock the cylinder into position as the outer ring is held in position by abutting a shoulder 38 in the barrel and a side 40 of the retaining ring and the joined inner ring abuts shoulder 42 on the cylinder. A valve seat 44 of flexible material in the form of a shaped ring is joined by a series of fasteners 45 to the inner ring of the spacer 36 in a manner to extend over the end of the cylinder and form the valve seat. In this embodiment the seat was made of a neoprene rubber, but it could be made of silicone rubber or other known flexible materials. An accumulator 46 is formed by the spacing between the barrel and the cylinder and an O-ring 48 acts as a seal at the working end of the cylinder. At the opposite end of the cylinder a valve 50 is located to control communication between the accumulator and the inside of the cylinder. This valve has essentially tubular walls 52 with one end of the tube closed with a head 54. This head is preferably dome shaped and has a centrally located tube 56 extending inward from the head with the tube forming an opening 58 through the head of the valve. The valve moves in an axial direction with the tubular walls sliding between the retainer ring 18 and the end cap 20 while the centrally located tube moves within an aligned opening 60 which extends completely through the end cap. A second opening 62 extends through the end cap to give communication between the back side of the head of the valve and the atmosphere. The valve is sealed with O-rings 64, 66 and 68.

At the working end of the gun a retainer member 70 is fastened to end cap 16 with fasteners 72, only one of which is shown. The end cap and retainer hold an anvil 74 which is axially located and is slideably and axially movable on bushings 76 and 78. This anvil extends inside the cylinder at one end and outside the gun at the other end. A series of openings 80 extend through the end cap to continuously provide communication from the inside 82 of the cylinder and atmosphere.

This single impact rivet gun is operated and controlled with a pneumatic system. To actuate the main valve 50 compressed air enters from line 84, through connector 86, which is threaded into end cap 20, the compressed air opens three way valve 88, goes out passageway 90 and into chamber 92. With the entry of the compressed air into the chamber a shoulder 94 on the main valve is acted on to drive the main valve forward against valve seat 44. When valve 88 is closed air from the chamber 92 exhausts through that valve and outlet 96. O-ring 98 acts as a seal.

Compressed air is introduced into the accumulator 46 from line 100, through connector 102, which is threaded into the end of the end cap 20 the compressed air opens a second three way valve 104, goes through passageway 106 and into the accumulator. When valve 104 is closed off air from the accumulator exhausts back through that valve and outlet 108. O-ring 110 acts as a seal.

When compressed air enters line 112 it passes through connector 114, which is fastened to a cover plate 116, and the air pressure opens two way valve 118 to let the air flow through passageway 120. This passageway is turned back on itself to direct the air outward in the opening 60 of end cap 20 which creates a vacuum in opening 58 as long as compressed air is flowing.

At the working end of the rivet gun a connector 122 is threaded into end cap 16 and a passageway 124 opens into chamber 126. A side 128 of that chamber is shaped to match surface 130 which is on a sloping part of an enlarged area 132 of anvil 74. Air from line 134 passes into the passageway and if the anvil is pressed toward the rivet gun the surface 130 will close off the passageway so that pressure builds up in line 134, however, if the anvil is not against surface 128 pressure will not build up in that line.

Access is available to the accumulator 46 with a connector 136 threaded into the retainer ring 18 and a passageway 138 communicating with the inside of the accumulator. Tubing 140 is joined to the connector.

Figure 1:
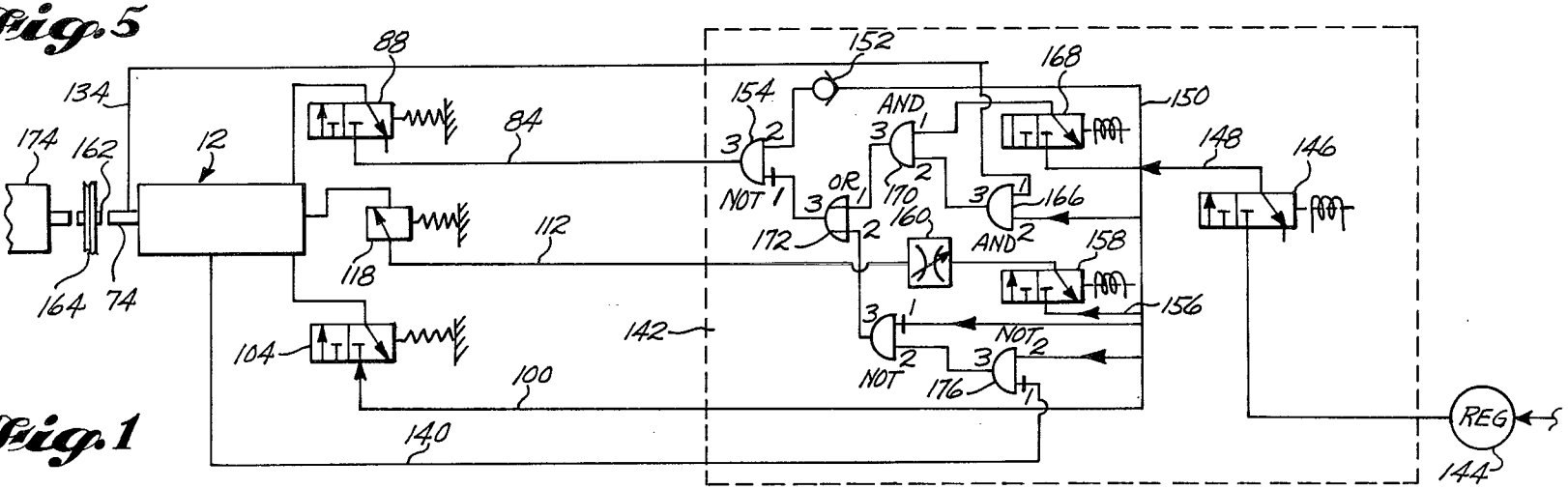
FIG. 1 shows a schematic of the air logic system of this invention.
Figure 2:
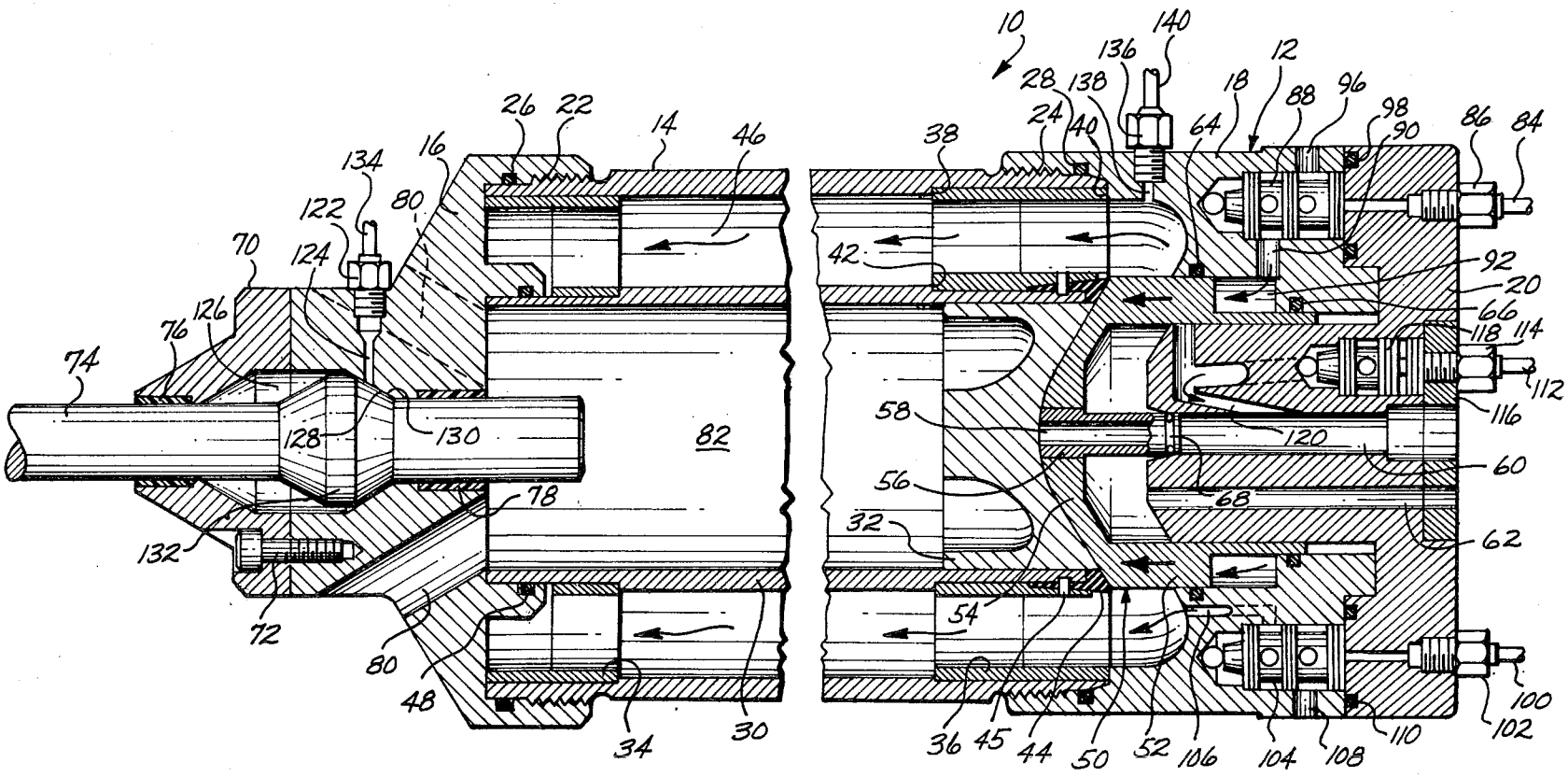
FIG. 2 is a side elevational sectional view of the single impact rivet gun of this invention with the gun in starting position and ready to fire.
Figure 3:
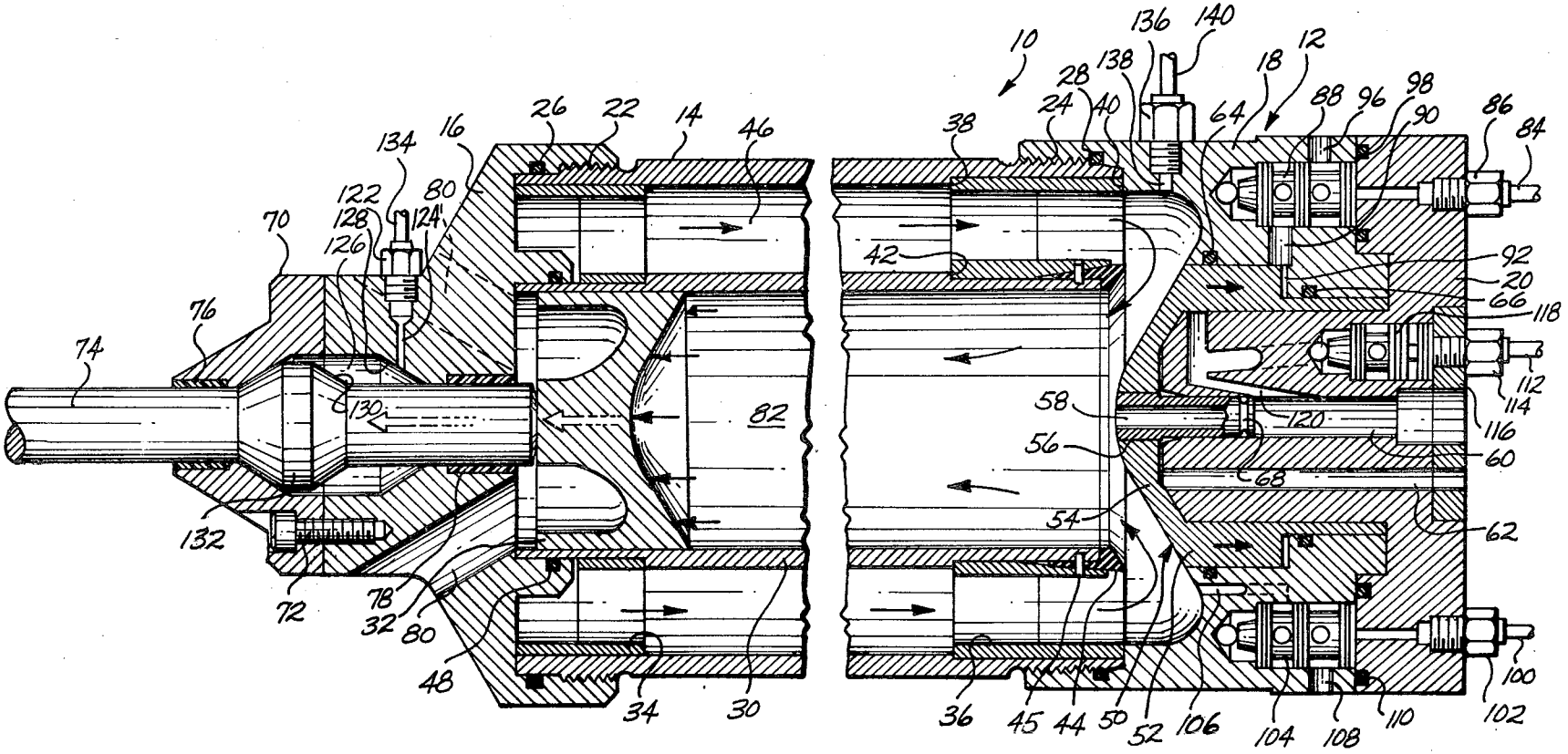
FIG. 3 shows a side elevational sectional view of the single impact rivet gun of this invention with the gun in the fired position.
Figure 4:
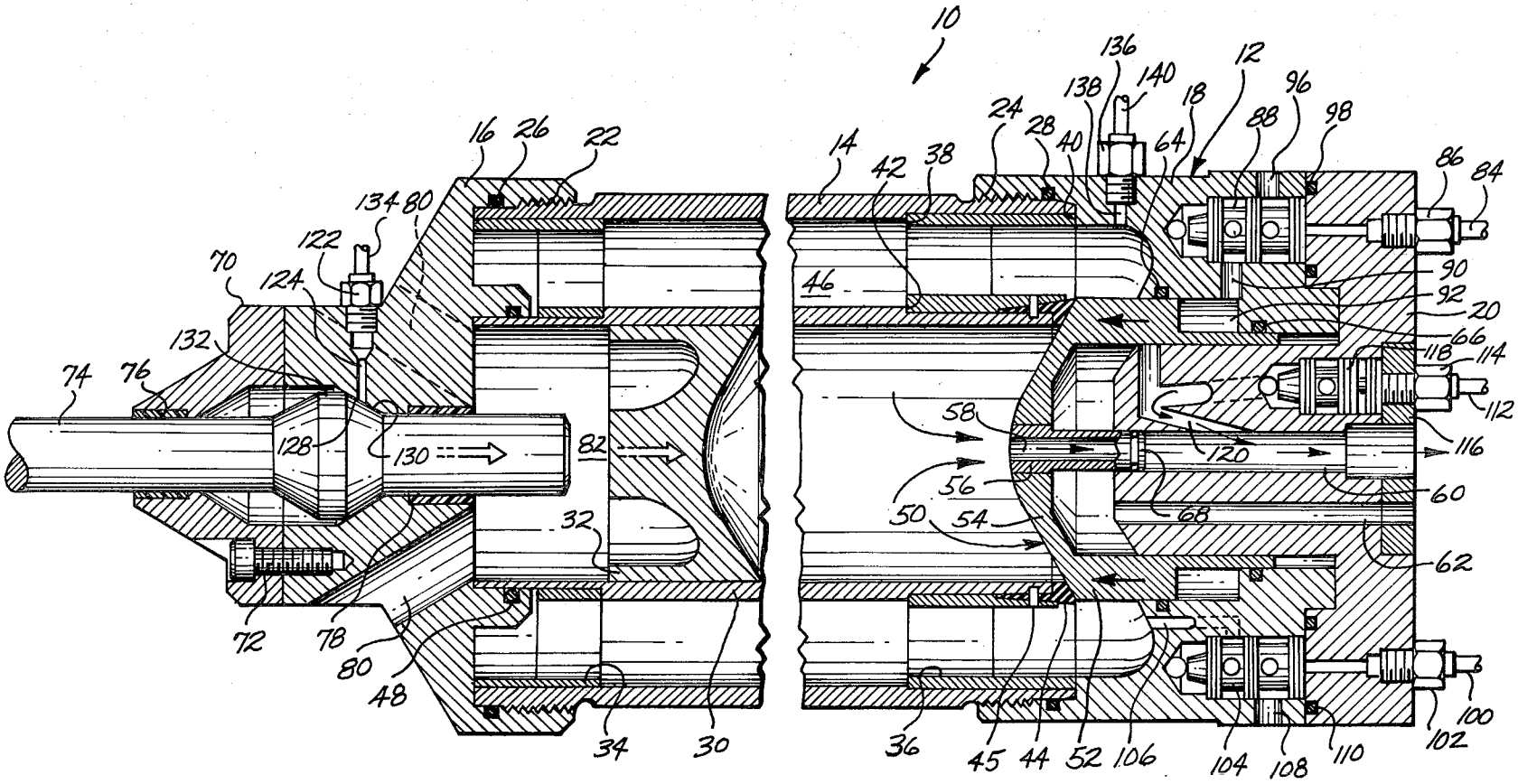
FIG. 4 shows a side elevational sectional view of the single impact rivet gun of this invention with the fired gun returning to the starting position.

The pneumatic system 142 for controlling the valving for the single impact gun is as shown in FIG. 1. Compressed air from a source not shown passes through regulator 144 and into three way valve 146 which in this embodiment is shown as solenoid operated however it could be manually actuated. This valve is normally closed and exhausting to atmosphere. When the solenoid opens the valve the compressed air passes through the valve and into line 148 after which it diverges into several lines. One of those lines 150 leads through a check valve 152, through valve 154 which is normally open then through line 84 and into a spring held closed valve 88 which is opened by the pressure to enter chamber 90 and force main valve 50 to a normally closed position. At the same time the air goes through line 100 to open valve 104 and introduce air into the accumulator 46. As pressure builds up in the accumulator it passes through passageway 138 then into line 140. Thus the pressure or lack of same gives a signal as to whether the accumulator is or is not pressurized.

The compressed air from 148 passes into line 156, and normally closed solenoid actuator valve 158 when actuated to open passes the compressed air through sequence timer 160 and into line 112 where the pressure opens valve 118 to create a vacuum in openings 58 and 60 to pull piston 32 to a starting position against the head 54 of valve 50.

As part of the control system three different types of special valves are used. These valves are designated as "and", "or" and "not". The "and" valve only opens to outlet line designated as 3 when inlet lines 1 and 2 are both pressurized. The "or" valves open to outline line 3 when either line 1 or 2 is pressurized. The "not" valves open to outlet line 3 when inlet line 2 is pressurized but will close and exhaust line 3 when line 1 is also pressurized. These special valves are available from the Miller Fluid Power Corporation, where the "and", "or" and "not" valves are respectively designated as: and element, type 81.622.0; or element, type 81.521.0; and not element, type 81.504.020.

In operation valve 146 is opened to pressurize the system which introduces air through valve 154, line 84 and valve 88 to move the main valve 50 inside the gun to the starting position; which closes off the accumulator 46; which then is filled through line 100 and valve 104 and pressure is built up in line 140. Next suction control valve 158 is actuated to send compressed air through line 112 and valve 118 to create a vacuum is opening 60 and pull the piston 32 to a starting position. Then the anvil 74 is pressed against rivet 162 located in the work part 164 which closes off passageway 124 and allows pressure to build up in line 134. This activates "and" valve 166 so that when three way trigger valve 168 is opened "and" valve 170 opens to send air pressure through "or" valve 172 which pressurizes inlet line 1 of "not" valve 154 to close that valve and exhaust line 84 to dump air out of chamber 92. This allows pressure from the accumulator 46 to open main valve 50 to dump compressed air from the accumulator into the inside of cylinder 30 to rapidly drive piston 32 forward to impact anvil 74 and set the rivet. Of course bucking unit 174 was in position against the rivet before the cycle started. As pressure goes out of line 134 or when trigger valve 168 is closed line 84 again is pressurized and the main valve is moved to the starting position to permit pressure buildup in the accumulator then suction control valve 158 is actuated to bring the piston to the starting position and ready to set another rivet.

When the riveting is completed compressed air valve 146 is closed and pressure exhausted out of the lines. Check valve 152 prevents line 84 from exhausting and this maintains pressure in chamber 92 to keep the main control valve 50 closed. Accumulator pressure from line 140 acting upon not valve 176 prevents accidental closing of valve 154 and exhausing line 84 until after the pressure is exhausted from the accumulator.

FIG. 5 shows the single impact rivet gun 10 mounted and opposed by a mounted bucking gun 174 for setting a rivet. This rivet gun may be manually actuated or may be completely automated.

I claim:

1. In an improved single impact rivet gun having, a cylinder, a piston movably mounted in the cylinder, and a pneumatic accumulator to supply air pressure to force the piston against an anvil located in the working end of the cylinder and thereby form a rivet wherein the improvement comprises: the gun having openings through the working end to continually expose the working side of the piston to the atmosphere, a valve to control flow of air from the accumulator to the cylinder and with said valve located to be abutted by the back side of the piston when the piston is in a starting position, the gun having a permanent opening extending through the valve into the cylinder to continuously communicate between the back side of the piston and the atmosphere, means for introducing air in an outward direction through the opening to create a vacuum to pull the piston into a starting position, and means for actuating the valve to introduce air from the accumulator into the cylinder to drive the piston against the anvil and set a rivet.

2. In an improved single impact rivet gun as in claim 1 with improvement further comprising: a sensor interlock to prevent accidental firing of the rivet gun with the sensor located to be energized and permit firing when the anvil is pressed into a starting position and contacting a rivet to be set.

3. In an improved single impact rivet gun having, a cylinder, a piston movably mounted in the cylinder, and a pneumatic accumulator to supply air pressure to force the piston against an anvil located in the working end of the cylinder to form a rivet, wherein the improvement comprises: the gun having openings through the working end to continually communicate between the inside of the cylinder and the atmosphere and having a permanent opening through the control end to continually communicate between a back side of the piston and the atmosphere, means for introducing suction to the opening in the control end to pull the piston to the starting position, and means for controlling introduction of air from the accumulator into the cylinder to drive the piston against the anvil to set the rivet.

4. An improved single impact rivet gun as in claim 3 wherein the means for introducing suction comprises air outwardly directed through the permanent opening in the control end of the gun.

5. An improved single impact rivet gun as in claim 3 wherein the improvement further comprises a pneumatic controlled interlock sensor means to prevent accidentaly firing of the gun.

6. A single impact rivet gun comprising: a housing, a cylinder concentrically located within the housing to form an accumulator therebetween, a piston movably mounted in the cylinder, an anvil located in a working end of the rivet gun to extend within the cylinder to permit impacting the anvil by the piston to drive a rivet, the working end having a series of openings to continuously communicate between the inside of the cylinder and the atmosphere, a valve slidably mounted in a control end of the rivet gun and located to control communication between the accumulator and the inside of the cylinder and the valve having an opening therethrough to continuously communicate between the back side of the piston inside of the cylinder and the atmosphere, means for charging the accumulator with compressed air, means for introducing air in an outward direction through the opening at the control end of the gun to create a vacuum and pull the piston into the starting position, and means for actuating the valve to introduce air from the accumulator into the cylinder to drive the piston against the anvil and set the rivet.

7. A single impact rivet gun as in claim 6 further comprising means for preventing an air pressure buildup required to permit firing of the rivet gun unless the anvil is pressed against a rivet to be fired.

8. A single impact rivet gun as in claim 6 further comprising means for preventing firing of the rivet gun when the accumulator is being exhausted.

* * * * *